United States Patent [19]

Würfe et al.

[11] Patent Number: 4,894,675

[45] Date of Patent: Jan. 16, 1990

[54] APPARATUS FOR SPLICING TOGETHER UNDEVELOPED CUSTOMER FILMS IN A DARKROOM

[75] Inventors: Reinhart Würfe, Munich; Helmut Zangenfeind, Puchheim; Rainer Türcke, Taufkirchen, all of Fed. Rep. of Germany

[73] Assignee: AGFA-Gevaert Aktiengesellschaft, Leverkusen, Fed. Rep. of Germany

[21] Appl. No.: 264,806

[22] Filed: Oct. 28, 1988

[30] Foreign Application Priority Data

Nov. 6, 1987 [DE] Fed. Rep. of Germany ..... 3737801

[51] Int. Cl.[4] ..... G03D 13/06

[52] U.S. Cl. ..... 354/308; 354/310; 354/314

[58] Field of Search ..... 354/307, 308, 310, 311, 354/312, 313, 314, 319

[56] References Cited

U.S. PATENT DOCUMENTS

| | | | |
|---|---|---|---|
| 4,543,151 | 9/1985 | Aldo | 354/310 |
| 4,565,442 | 1/1986 | Benker et al. | 355/68 |
| 4,621,970 | 11/1986 | Würfel et al. | 414/412 |
| 4,643,371 | 2/1987 | Würfel et al. | 242/55 |
| 4,704,026 | 11/1987 | Rauh et al. | 355/68 |
| 4,732,278 | 3/1988 | Zangenfeind et al. | 198/406 |
| 4,799,076 | 1/1989 | Zangenfeind et al. | 354/308 |

FOREIGN PATENT DOCUMENTS 2545214 1/1980 Fed. Rep. of Germany .

*Primary Examiner*—A. A. Mathews

*Attorney, Agent, or Firm*—Peter K. Kontler

[57] ABSTRACT

A darkroom contains a first film unwinding unit which receives reels with convoluted undeveloped customer films from a device serving to remove reels from their cassettes. Each film which is being unwound from its reel is normally advanced in a first channel to a splicer which connects its leader to the trailing end of the preceding film to form a long web which is collected into a large roll prior to transfer into a developing machine. A second unwinding unit in the darkroom can receive reels with damaged films from the first unit or from another source of undeveloped films and has a receptacle for reels. A second channel extends from an outlet of the receptacle to a portion of the first channel ahead of the splicer. The two units can be reached by hands which must extend through contractible openings of two cuffs and thereupon through a contractible opening between several curtains of the darkroom. This enables an operator to transfer individual reels from the first unit into the receptacle of the second unit and to initiate the advancement of film into and through the second channel and severing of film in the second channel.

33 Claims, 2 Drawing Sheets

APPARATUS FOR SPLICING TOGETHER UNDEVELOPED CUSTOMER FILMS IN A DARKROOM

BACKGROUND OF THE INVENTION

The invention relates to apparatus for manipulating photographic roll films, especially exposed but undeveloped customer films which are shipped or otherwise delivered to photographic processing laboratories for development or for development and the making of prints on photographic paper or the like. More particularly, the invention relates to improvements in apparatus for manipulating undeveloped roll films in a darkroom.

It is known to admit cassettes with reels for exposed but undeveloped roll films into a darkroom, to remove the reels from their cassettes in the darkroom, to unwind films from the reels in the darkroom, and to unite a large number of films into an elongated web or strip which is converted into a large roll and is thereupon transferred from the darkroom into a developing machine. Reference may be had to German Pat. No. 25 45 214 which discloses the placing of a darkroom into a room that is illuminated by daylight or artificial light. This patent further suggests automation of the manipulation of cassettes, reels and films in the darkroom.

The apparatus of the German patent operates satisfactorily in connection with a majority of cassettes, reels and films. However, such apparatus cannot readily process certain types of cassettes or films (known as problem cassettes and films), especially the so-called 135-cassettes. Moreover, conventional apparatus cannot readily process (a) films which are convoluted on their reels in the wrong direction, particularly as a result of improper winding of film in a camera, (b) films with leading ends (tongues) whose size and/or shape deviates from a standard size and/or shape so that the leading ends cannot be engaged by the unwinding instrumentalities, (c) films which are bent or otherwise deformed to such an extent that they cannot be automatically transported from the unwinding station to the splicing station, and (d) films with damaged perforated marginal portions which interfere with orderly transport of films to the splicing station. If a presently known automatic apparatus receives such a problem cassette or film, it generates a signal after several unsuccessful attempts to process the film, and an attendant then removes the problem cassette or film from the darkroom.

The apparatus of the aforementioned German Pat. No. 25 45 214 embodies a separate film introducing facility with a channel which directs a manually inserted problem film into the channel leading to the splicing station. Such manipulation of a problem film necessitates the establishment of a second darkroom around the separate film introducing facility and the darkroom for the film unwinding and splicing devices. The darkroom for the film unwinding and splicing devices is then opened, the problem film is removed from the unwinding device, and the leading end of the problem film is introduced into the channel of the separate facility until it reaches the automatic film advancing means and is transported all the way to the splicing station. The darkroom for the unwinding and splicing devices is then sealed against penetration of light and the surrounding area is again ready to receive daylight or artificial light. Thus, the just described apparatus actually operates with two darkrooms one of which is disposed within the other and the other of which can be illuminated only when the one darkroom is adequately sealed. This creates numerous problems, especially as concerns proper synchronization of operation of various units in the inner darkroom, the overall space requirements of the apparatus and the initial and maintenance cost.

In accordance with a more recent proposal which is disclosed in commonly owned copending patent application Ser. No. 040,868 of Zangenfeind et al., now U.S. Pat. No. 4,779,076 a single darkroom is provided with two cuffs defining contractible openings for the hands of an operator. Once the hands extend through the openings of the cuffs, they can displace one or two curtains to expose an additional opening affording access to the interior of the darkroom. Such inlet renders it possible to carry out certain manipulations in the interior of the darkroom without the need for a darkening of the area around the darkroom. Zangenfeind et al. propose to remove the problem film and/or its reel and/or the respective cassette from the reel removing or unwinding unit in the darkroom and to insert it into a receptacle wherein the film is sealed from light and can be withdrawn from the darkroom for the purpose of processing in a different apparatus. For example, the film in a receptacle of the just outlined character can be processed in a so-called hanger type machine wherein the processing operation takes up much more time than in an automatic processing machine. It is further necessary to separate the corresponding customer envelope from other envelopes (for automatically processed films) so that the problem film can be inserted into the appropriate customer envelope prior to shipment to a dealer or directly to a customer. A drawback of this proposal is that the processing of problem films takes up too much time and the cost of processing is several times that of the cost of automatic processing. In addition, there is always the possibility of misplacing the problem films and/or their envelopes. Still further, it is thereupon necessary to splice the developed problem films end-to-end for transport through a copying machine if the customers owning problem films wish to obtain prints of the images of film frames. Thus, a processing laboratory wherein problem films are processed in the just outlined manner must maintain two splicing devices, one for automatically processed films and another for problem films.

OBJECTS OF THE INVENTION

An object of the invention is to provide an apparatus wherein a single darkroom suffices for adequate processing of satisfactory films and problem films.

Another object of the invention is to provide the apparatus with novel and improved means for manipulating problem films in a darkroom.

A further object of the invention is to provide an apparatus wherein problem films can be processed, particularly united with other problem films and with satisfactory films into elongated webs or strips, within a fraction of the time which is required for such operations in accordance with heretofore known proposals.

An additional object of the invention is to provide a novel and improved darkroom for use in the above outlined apparatus.

Still another object of the invention is to provide a novel and improved mechanism for unwinding and otherwise manipulating problem films in a darkroom.

Another object of the invention is to provide an apparatus wherein problem films can be processed in the same order in which they are introduced into the darkroom so that the likelihood of misplacing problem films or introducing developed problem films and corresponding prints into wrong customer envelopes is reduced to a minimum.

A further object of the invention is to provide the apparatus with novel and improved means for introducing problem films into the path for satisfactory films.

Another object of the invention is to provide a novel and improved method of processing satisfactory and problem films in a common dark chamber.

An additional object of the invention is to provide novel and improved means for supporting reels with problem films in a darkroom.

A further object of the invention is to provide an apparatus wherein problem films can be processed with satisfactory films in a small darkroom and which is constructed and assembled in such a way that the likelihood of injury to a person manipulating problem films is nil or negligible.

SUMMARY OF THE INVENTION

The invention is embodied in an apparatus for converting undeveloped photographic roll films which are convoluted on reels into a continuous web or strip of coherent films. The apparatus comprises a darkroom, first and second film unwinding units in the interior of the darkroom, web collecting means (such as a large reel and a motor for driving the reel) in the darkroom, means defining in the darkroom a first film channel extending from the first unwinding unit toward the collecting means, means for splicing together successive films in the first channel end-to-end so as to convert the films into a web or strip, and means defining a second film channel which extends from the second unit to a portion of the first channel between the splicing means and the first unwinding unit. The darkroom has at least one normally sealed inlet for affording access to the unwinding units by at least one hand of an operator for manual transfer of reels from the first unwinding unit into the second unwinding unit and, if necessary, for threading the film on a transferred reel into the second channel. The inlet of the darkroom can further serve for introduction of airtightly sealed containers for undeveloped films into the interior of the darkroom so that the containers can be opened in the interior of the darkroom and the reels with corresponding roll films thereon introduced into the second unwinding unit.

The apparatus can further comprise means for feeding cassettes with reels of undeveloped films into the darkroom, means for removing reels from cassettes in the darkroom, and means for transferring reels from the removing means into the first unwinding unit.

The second unwinding unit preferably comprises a receptacle for transferred reels, and the second channel extends from such receptacle to the aforementioned portion of the first channel.

Still further, the apparatus can comprise means for trimming the leaders or leading ends of films in at least one of the two channels in the interior of the darkroom and/or means for trimming the trailing ends of films in at least one of the channels.

The inlet of the darkroom can comprise a first light barrier having at least one normally sealed manually expandible first opening for the hand of an attendant, and a second light barrier between the first light barrier and the interior of the darkroom. The second light barrier has at least one normally sealed second opening which is expandible by the hand that already extends through the first opening. Such inlet effectively prevents penetration of outside light into the interior of the darkroom when an attendant wishes to transfer a reel from the first unwinding unit into the receptacle of the second unwinding unit or to introduce a cassette with a reel of roll film into the interior of the darkroom.

The second unwinding unit further comprises means for advancing the film form a reel in the receptacle along the path which is defined by the second channel so that the film advances toward the aforementioned portion of the first channel. Such apparatus can further comprise means for severing (e.g., for trimming the leaders and/or the trailing ends of) films in the second channel. The receptacle of the second unwinding unit is preferably provided with an open reel-admitting side which confronts the inlet of the darkroom so that it can be readily reached by a hand extending through the inlet for the purpose of inserting a reel into or for withdrawing a reel from the receptacle. The receptacle preferably defines for reels an elongated compartment which includes two substantially mirror symmetrical halves. An outlet of the receptacle communicates with the compartment substantially intermediate the two halves and serves to direct the leader of a film in the compartment into the second channel. As mentioned above, the second unwinding unit further comprises means for advancing films from the compartment in the receptacle toward and into the second channel or along the path which is defined by the second channel so that the films advance into the aforementioned portion of the first channel. Such advancing means can include mobile film engaging elements which are adjacent the outlet of the receptacle. The compartment of the receptacle is or can be dimensioned in such a way that it can receive a reel in each of its halves. The mobile elements of the means for advancing films in the second channel can include a driven roll at one side of the path which is defined by the second channel, and an idler roll at the other side of such path opposite the driven roll. At least one of the rolls can be mounted on the receptacle. The second unwinding unit can further comprise a mobile closure for the open side of the receptacle, and the other roll of the advancing means can be mounted on such closure. Means can be provided for movably mounting the closure in the darkroom, and such mounting means can including one or more hinges. The closure is preferably movable to and from an operative position in which it overlies the open side of the receptacle, and the second unwinding unit can further comprise means for biasing the other roll (namely the roll which is mounted on the closure) toward the one roll when the closure assumes its operative position. Means can be provided for releasably locking the closure in the operative position, and such locking means can include the aforementioned biasing means.

The closure is preferably movable relative to the receptacle when it assumes the operative position. Such movement is preferably in directions to move the other roll (which is mounted on the closure) toward and away from the one roll (which is mounted on the receptacle). The locking means can include a pawl, and the biasing means can include at least one spring which serves to urge the pawl against the closure in the operative position of the closure and to thereby urge the other roll against the one roll, and more specifically against the film which extends through the nip of such rolls.

The apparatus can further comprise prime mover means for the driven roll of the means for advancing films in the second channel. Alternatively, or in addition to such prime mover means, the second unwinding unit can comprise manually operable means for rotating the driven roll of the advancing means. To this end, the closure can be provided with an aperture and the manually operable means can comprise a rotary input member (such as a shaft) which extends toward the inlet of the darkroom and through the aperture in the operative position of the closure.

The outlet of the receptacle which forms part of the second unwinding unit is preferably disposed in a substantially horizontal plane, and the second unwinding unit preferably further comprises means for movably supporting the receptacle so that the receptacle is movable substantially at right angles to the horizontal plane of the outlet. Still further, such second unwinding unit ca comprise means for severing the film in the second channel, and the severing means can include first cutter means which is movable with the receptacle and fixed second cutter means which is adjacent the first cutter means. Such receptacle is preferably movable between a first position in which the severing means is inoperative and a second position. The first cutter means serves to cooperate with the second cutter means so as to sever the film in the second channel during movement of the receptacle from the inoperative to the second position. The second unwinding unit can further comprise means for biasing the receptacle to its inoperative position. Manually engageable means can be provided for moving the receptacle to the second position, i.e., to sever a film in the second channel. The aforementioned closure for the open side of the receptacle is preferably mounted and dimensioned in such a way that it affords access to the manually engageable means when it overlies the open side of the receptacle and prevents access to the manually engageable means while the receptacle is accessible for insertion or removal of reels into and from its compartment.

The means for actuating the severing means can include the aforementioned manually engageable means for moving the receptacle to its second position. Alternatively, the actuating means for the severing means can include a fluid-operated motor, an electromagnet or another suitable prime mover. Still further, the apparatus can comprise means for initiating the severing of film in the second channel by way of the actuating means. Such initiating means can include means for monitoring the tension of film in one of the channels and for transmitting to the actuating means a signal when the monitored tension reaches a predetermined value. Alternatively, the initiating means can comprise means for scanning one of the channels for the presence of a moving film therein and for transmitting to the actuating means a signal in response to detected stoppage of the film.

The path which is defined by the second channel is preferably horizontal or substantially horizontal in the region of the outlet of the receptacle and preferably slopes downwardly with respect to the outlet in the region of the severing means for the film. For example, the path portion in the region of the severing means can slope downwardly through an angle of approximately 30 degrees. Such path can further include a substantially vertical portion which extends from the downwardly sloping portion toward the aforementioned portion of the first channel. The second channel can include a substantially funnel-shaped film guiding portion between the two portions of the path which is defined by the second channel, namely between the downwardly sloping portion and the substantially vertical portion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred embodiments with reference to the accompanying drawing.

DESCRIPTION OF PREFERRED EMBODIMENTS

Figure 1:
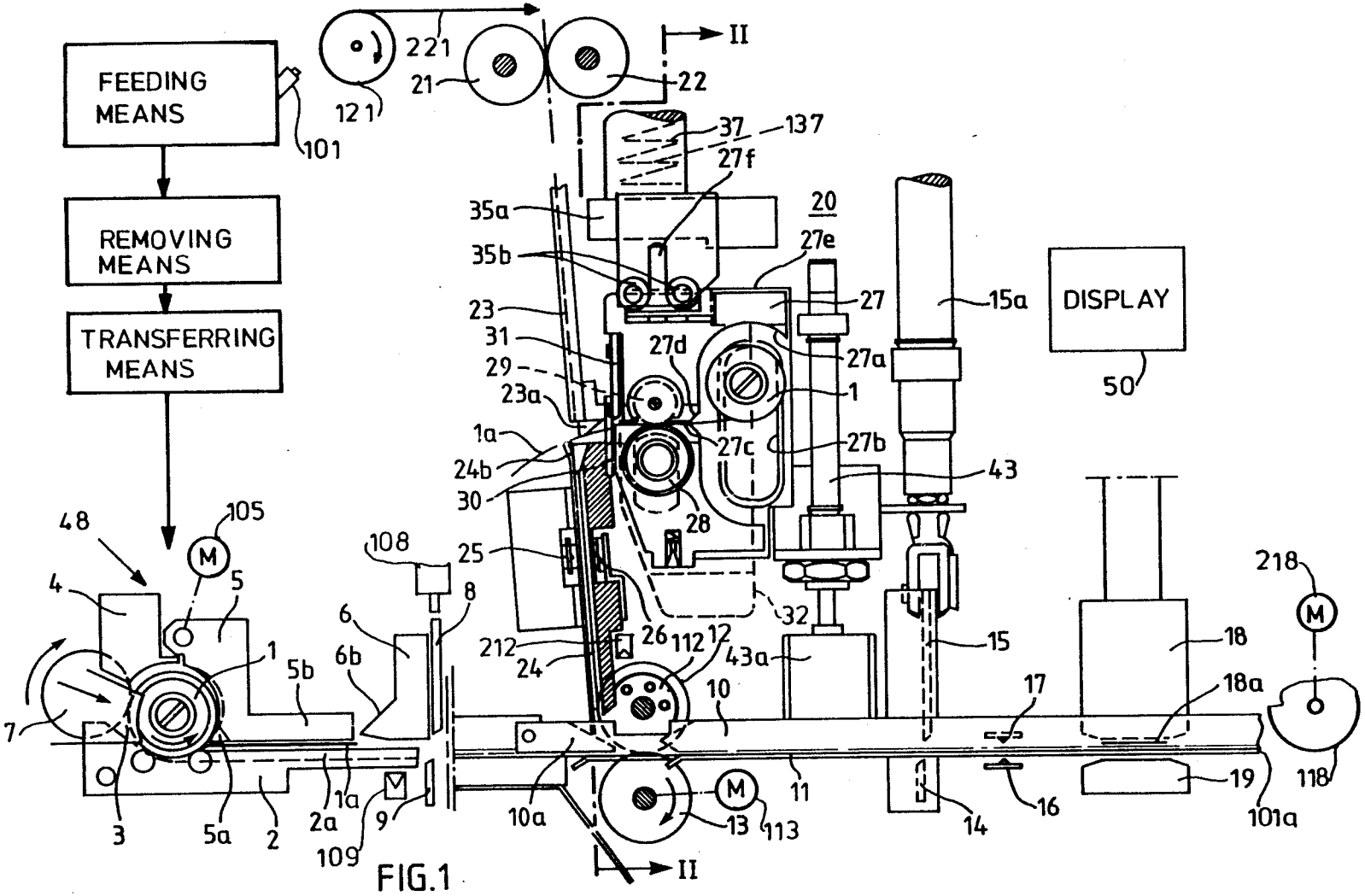
FIG. 1 is a partly diagrammatic, partly elevational and partly vertical sectional view of an apparatus which embodies the invention, with the darkroom omitted.
Figure 2:
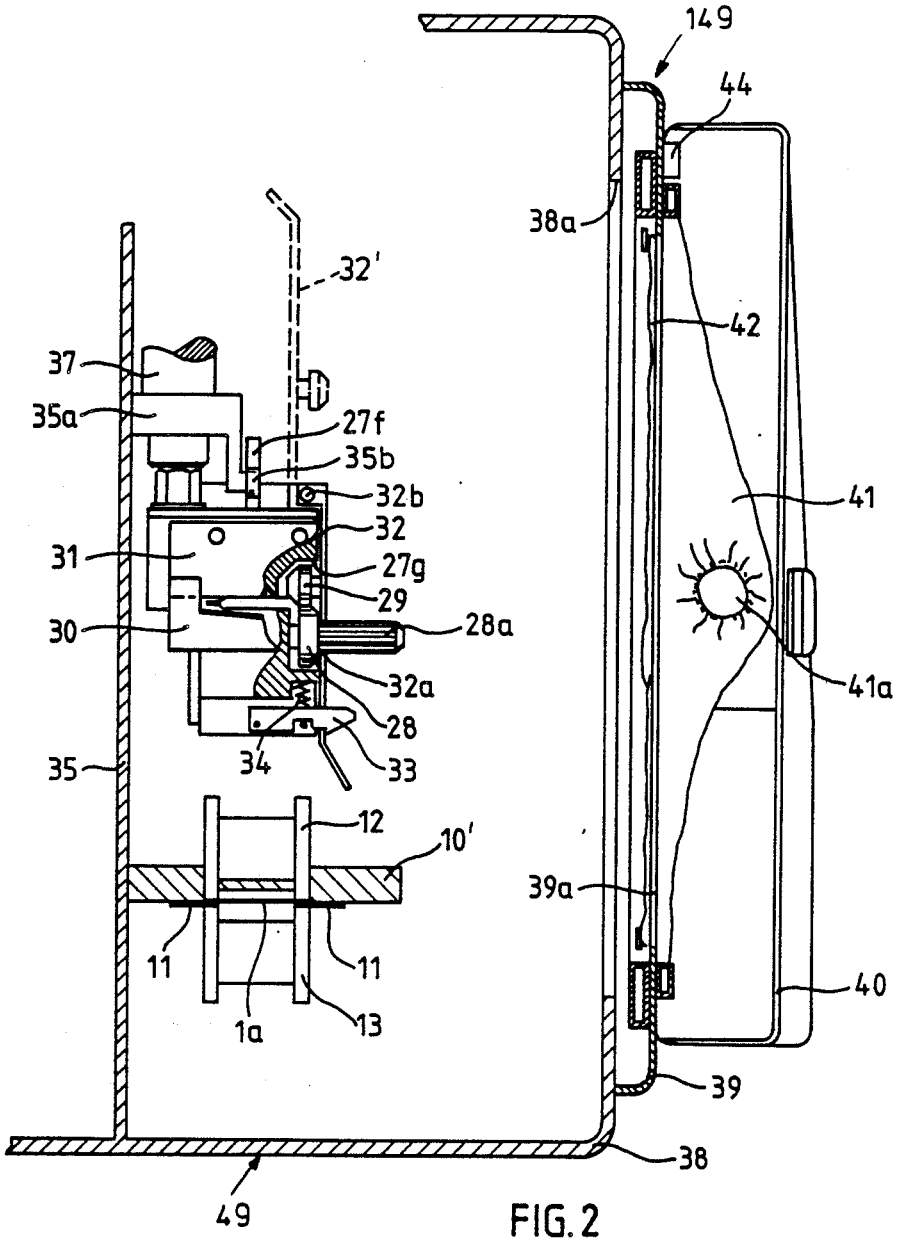
FIG. 2 is a transverse sectional view substantially as seen in the direction of arrows from the line II—II of FIG. 1.

FIG. 2 shows a portion of a darkroom 49 which confines a feeding device 45 (shown schematically in FIG. 1) serving to introduce cassettes 101 with exposed but undeveloped customer films la into the interior of the darkroom 49 by way of a downwardly sloping duct in a manner as disclosed in commonly owned U.S. Pat. No. 4,621,900 to Würfel et al. (granted Nov. 11, 1986) or in commonly owned U.S. Pat. No. 4,732,278 to Zangenfeind et al. (granted Mar. 2, 1988). The disclosures of these patents, as well as of the aforementioned copending patent application Ser. No. 040,868 of Zangenfeind et al., are incorporated herein by reference. The feeding means 45 delivers successively admitted cassettes 101 to a reel removing device 46 which may be of the type disclosed in the aforementioned U.S. Pat. No. 4,621,970 to Würfel et al., and a mechanism 47 transfers removed reels 1 from the device 46 into a first film unwinding unit 48. The transferring mechanism 47 may be similar to that disclosed in the aforementioned U.S. Pat. No. 4,621,970, and the first unwinding unit 48 may be similar to or identical with that which is disclosed in commonly owned U.S. Pat. No. 4,643,371 to Würfel et al. (granted Feb. 17, 1987).

Certain details of the first unwinding unit 48 are shown in the left-hand portion of FIG. 1. This unit comprises a plurality of stationary and movable walls which define a chamber serving to receive one reel 1 at a time. The walls together form a housing with a stationary upper section or wall 4, a pivotable second upper section or wall 5, a movable lower section or wall 2, and a stripping device **5*a* which can form an integral or detachable part of the section or wall 5. A reel 1 which is confined in the housing including the sections or walls 2, 4 and 5 can be rotated by a friction wheel 7 so that the film 1*a* is unwound and is caused to advance in a horizontal path defined by two elongated extensions 2*a* and 5*b* of the respective sections or walls 2 and 5 of the housing of the first unwinding unit 48. The section or wall 5 can be pivotably mounted on the stationary section or wall 4 and can be pivoted between the illustrated operative position and an inoperative position by a suitable motor 105. The marginal portions of the film 1***a* which is being unwound in the unit 48 advance between lateral guides 3 which are disposed at a level above the housing section or wall 2. The sections or walls 2 and 4 define a space which provides room for introduction of the friction wheel 7 into engagement with the flanges of the reel 1 which rests in the chamber of the unwinding unit 48. When the friction reel 7 is driven, it rotates in a clockwise direction to thereby rotate the reel 1 in a counterclockwise direction. If the leader of the film 1*a* tends to adhere to the nearest convolution of film which is stored on the core of the reel 1, it is stripped off such convolution by the device 5*a* of the section or wall 5 while the latter dwells in the operative position of FIG. 1.

When the friction reel 7 has advanced the leader of the film 1*a* into the range (i.e., into the nip) of two transporting rolls 12 and 13 in the darkroom 49, the motor 105 pivots the section or wall 5 to the inoperative position so that the reel 1 can leave its chamber and is pulled by the advancing film 1*a* against a stationary bearing member 6 having an upwardly sloping ramp 6*b* for the flanges of the reel 1. This enables the transferring mechanism 47 to deliver a fresh reel 1 into the chamber of the unwinding unit 48 while the reel 1 abuts the ramp 6*a* of the bearing 6 and can continue to pay out the film 1*a*.

The right-hand side of the bearing 6 carries guide means (not specifically shown) for a vertically reciprocable trimming knife 8 which can cooperate with a stationary lower trimming knife 9 to trim the leaders and trailing ends of successive films 1*a*. The means for reciprocating the trimming knife 8 relative to the bearing 6 and fixed trimming knife 9 comprises a motor 108, such as a fluid-operated motor. However it is equally possible to employ an electromagnet or any other suitable prime mover which is capable of moving the trimming knife 8 in response to signals which are transmitted by a control circuit (such as the control circuit disclosed in the commonly owned copending patent application Ser. No. 264,398 filed Oct. 28, 1989 by Zangenfeind for "Method of and apparatus for processing exposed photographic films". A pneumatic motor 108 is the presently preferred means for reciprocating the trimming knife 8 relative to the bearing 6 and fixed trimming knife 9.

The extensions 2*a* and 5*b* of the housing sections or walls 2 and 5 constitute portions of an elongated substantially horizontal first film channel 10 which extends from the first unwinding unit 48 and all the way to a web collecting means 118 serving to convert a series of successive customer films 1*a* into a large roll which is ready to be withdrawn from the darkroom 49 and transferred into a developing machine of any known design. The first film channel 10 extends past the trimming station including the knives 8, 9, past the transporting station including the transporting rolls 12 and 13, past a further trimming station including a stationary knife 14 and a movable knife 15, and on to a splicing device including a stationary anvil 19 at one side of the path which is defined by the channel 10 and a vertically movable heat-sealing device 18 which can apply strips 18*a* of heat-sealable material to the butting ends of successive neighboring films 1*a* so that such films are connected to each other end-to-end and together form an elongated strip or web 101*a* which is ready to be converted into a roll by the collecting means 118. The collecting means 118 can constitute or include a reel which can be driven by a motor 218. The film channel 10 can include an upwardly pivotable mobile part which is not specifically shown and is disposed between the bearing 6 and the transporting rolls 12 and 13. The main portion of the means defining the channel 10 is an elongated horizontal carrier 10' (see FIG. 2) which is secured to an upright wall 35 of the darkroom 49 and the underside of which has a relatively shallow groove for successive films 1*a*. The marginal portions of such groove are overlapped by sheet metal plates 11 so that the plates 11 cooperate with the carrier 10' to define an elongated horizontal path wherein satisfactory customer films 1*a* are compelled to advance from the reel 1 in the first unwinding unit 48 toward the collecting means 118.

The distance from the trimming station including the knives 8, 9 to the transporting rolls 12, 13 can equal or approximate two widths of a customer film 1*a*. The nip of the transporting rolls 12 and 13 is located in the path of movement of successive films 1*a* from the trimming station (knives 8, 9) toward the splicing device including the anvil 19 and the movable heat-sealing device 18. The lower transporting roll 13 is a friction wheel which can be driven in a clockwise direction (as seen in FIG. 1) by a suitable motor 113 and is rotatable about a fixed horizontal axis. The upper transporting roll 12 is preferably movable up and down against and under the bias of one or more springs (not shown) so that it bears against the transporting roll 13 or against a film 1*a* which advances toward the splicing station. The upper transporting roll 12 cooperates with means for monitoring the condition of the film 1*a* in the channel 10, namely for ascertaining whether or not such film is in motion. To this end, the roll 12 carries a perforated disc 112 which is scanned by a photoelectronic detector 212 serving to transmit signals which indicate whether or not the roll 12 is in motion. Furthermore, the frequency of signals which are generated by the detector 212 can be evaluated by the aforementioned control circuit to ascertain the length of the film which has advanced through the nip of the rolls 12, 13 while the rolls were in motion for a certain interval of time. The radiation source of the detector 212 transmits light in the non-actinic range of the spectrum. It goes without saying that the channel 10 for films 1*a* has suitable cutouts or recesses which enable the transporting rolls 12 and 13 to reach the film in the adjacent portion of the channel.

As can be seen in FIG. 2, each of the transporting rolls 12 and 13 resembles a reel with flanges at its axial end and a smaller-diameter portion or core between the flanges. This ensures that the flanges of the rolls 12 and 13 engage only the marginal portions but not the image-bearing frames of the films 1*a*. The motor 113 for the driven transporting roll 13 receives signals from the control circuit.

The movable knife 15 downstream of the transporting rolls 12, 13 is reciprocable by a pneumatic motor 15*a* and cooperates with the stationary lower knife 14 to sever the film 1*a* in the channel 10 ahead of the splicing station. The knives 14 and 15 are located downstream of a suitable ejector 43*a* which can expel from the channel 10 fragments of films behind the locus where the films are severed by the knives 14 and 15. The ejector 43*a* can resemble a vertically reciprocable ram which is movable up and down by a fluid-operated or another suitable motor 43. The ejector 43*a* can pass through a registering window in the channel 10 to expel remnants or fragments of severed films 1*a*. When in the idle position of FIG. 1, the underside of the ejector 43*a* is located flush with the upper side of the adjacent portion of the horizontal path which is defined by the channel 10.

The purpose of the severing means including the knives 14 and 15 is to trim portions of films which have uneven trailing ends. For example the need for such trimming or severing will arise if the trailing end of a film 1*a* was forcibly extracted from the respective reel 1 so that it is jagged and requires trimming in order to permit proper splicing to the leading end of the next-following film 1*a*. The arrangement is preferably such that the knives 14 and 15 sever the trailing ends of films 1*a* transversely of the longitudinal directions of the films.

The receptacle which collects remnants of films that are expelled from the channel 10 by the ejector 43*a* is not shown in the drawing. The severing station including the knives 14 and 15 is followed by a sensor arrangement including a lower sensor element 16 and an upper sensor element 17. One of these sensor elements can constitute a photodiode which transmits radiation in the non-actinic region. The purpose of the sensors 16, 17 is to ensure that the leader of each oncoming film 1*a* is properly located at the splicing station before a strip 18*a* is applied to connect such leader with the trailing end of the preceding film 1*a*, i.e., with the trailing end of the growing strip or web 101*a*.

The exact construction of the mechanism at the splicing station forms no part of the present invention. All that counts is to provide a device which is capable of splicing successive customer films 1*a* end-to-end so that they are converted into an elongated strip or web 101*a* which can be convoluted at the collecting station in order to form a large roll which is ready for transfer into the developing machine. The prime mover 218 which serves to rotate the reel of the collecting means 118 can constitute an electric motor or any other suitable device which can rotate the reel at the required speed.

The darkroom 49 further accommodates a second film unwinding unit 20 and a mechanism which defines a second film channel 24 serving to direct the leaders of selected customer films (particularly problem films) into the path which is defined by the channel 10. That portion of the channel 10 where the films which are delivered by way of the channel 24 enter the horizontal path for advancement into the nip of the transporting rolls 12 and 13 is defined by a cam 10*a* having a downwardly sloping upper side which automatically diverts the leaders of successive customer films 1*a* in the channel 24 toward the nip of the rolls 12 and 13. The vertical portion of the path which is defined by the second channel 24 can receive a band 221 by way of an additional channel 23. The band 221 can be withdrawn from a source 121 and can be advanced into the channel 24 by transporting rolls 21 and 22. The upper end of the vertical portion of the path which is defined by the second film channel 24 is adjacent a funnel-shaped film guiding portion 24*b* which serves to direct the leaders of problem films from reels 1 in the second film unwinding unit 20 toward the cam 10*a*, i.e., toward the predetermined portion of the channel 10. The funnel-shaped film guiding portion 24*b* is located upstream of a film monitoring device including a radiation source 25 at one side of the vertical portion of the path which is defined by the film channel 24 and a transducer 26 at the other side of such path portion. The transducer 26 transmits signals to the aforementioned control circuit of the improved apparatus. The channel 23 has a cam-shaped lower end portion 23*a* which can direct the leader of a film 1*a* into the funnel-shaped portion 24*b*.

As can be seen in FIG. 2, the upright wall 35 of the darkroom 49 supports a bracket 35*a* for a pneumatic motor 37 which contains a spring 137 serving as a means for biasing a movable receptacle 27 of the second film unwinding unit 20 to an inoperative position. The receptacle 27 is secured to the piston rod of the motor 37. The means for preventing angular movements of the receptacle 27 about the axis of the piston rod of the pneumatic motor 37 comprises an upwardly extending guide pin 27*f* which is an integral or separable part of the receptacle 27, and two rollers 35*b* which are mounted on the bracket 35*a* and flank the guide pin 27*f*. As mentioned above, the spring 137 in the cylinder of the pneumatic motor 37 tends to bias the receptacle 27 upwardly so that the receptacle assumes an inoperative position, insofar as its ability to initiate severing of a film 1*a* is concerned.

The receptacle 27 has an open side which confronts an inlet 149 (see FIG. 2) of the darkroom 49 and is provided with a vertically elongated compartment 27*a* which has two mirror symmetrical halves, namely and upper half and a lower half. Each of these halves can receive a reel 1. The height of the compartment 27*a* in the open side of the receptacle 27 is twice the diameter of a flange on a reel 1. The maximum width of the compartment 27*a* slightly exceeds the maximum diameter of a reel 1. The compartment 27*a* diminishes in width rearwardly (to the left, as seen in FIG. 2) in a direction away from the open side of the receptacle 27. The narrower portion 27*b* of the compartment 27*a* is remote from the open side of the receptacle 27 and serves to receive the outwardly extending end portion of the core of the inserted reel 1. The depth of the compartment 27*a* approximates the distance between the flanges of a reel 1.

The receptacle 27 has an outlet 27*c* which is substantially horizontal and is disposed substantially midway between the uppermost and lowermost ends of the compartment 27*a*. The purpose of the outlet 27*c* is to permit the leader of a problem film 1*a* in the receptacle 27 to advance first into the substantially horizontal and thereupon into the vertical portion of the path which is defined by the second film channel 24. The outlet 27*c* preferably tapers in a direction away from the compartment 27*a*, not only in a horizontal plane but also from above and from below so as to ensure adequate guidance of the leader of a problem film 1*a* into the nip of two advancing rolls 28, 29 serving to advance problem films from the compartment 27*a* toward the funnel-shaped film guiding portion 24*b*. The tapering lateral portions of the outlet 27*c* are designed to engage the perforated marginal portions of the leader of a problem film 1*a* without coming in contact with the image-bearing frames of such film. One of the tapering portions of the outlet 27*c* is shown in FIG. 1, as at 27*d*.

The roll 28 constitutes a mobile film engaging element of the means for advancing problem films 1*a* in the channel 24 and on toward the cam 10*a*. The roll 29 also constitutes a mobile film advancing element but it is an idler roll. The idler roll 29 can penetrate into a cavity 27*g* which is provided in the film unwinding unit 20 adjacent the compartment 27*a* of the receptacle 27. This idler roll 29 is rotatably mounted on a flap-shaped closure 32 which is pivotally secured to the receptacle 27 by one or more horizontal hinges 32*b*. This closure is movable between the solid-line position of FIG. 2 and a second position 32′ which is indicated in FIG. 2 by broken lines. The arrangement is preferably such that, when the closure 32 assumes the solid-line position of FIG. 2, it still has a certain freedom of movement along the open side of the receptacle 27 so that it can follow the bias of a spring 34 cooperating with a pawl 33 constituting a means for releasably locking the closure in its operative position. The pawl 33 is pivotably mounted on the receptacle 27 and can extend through an aperture 32*a* of the closure 32 when the latter assumes the solid-line position of FIG. 2.

The upper portion of the receptacle 27 is provided with a manually engageable handle 27*e* which can be depressed by a finger so that the entire receptacle moves downwardly against the opposition of the spring 137 in the pneumatic motor 37. The arrangement is preferably such that the manually engageable handle 27*e* is accessible only when the closure 32 assumes the solid-line position of FIG. 2, namely when it overlies the open side of the receptacle 27. When the closure 32 is moved to the second position 32′ of FIG. 2, it is located in front of the manually engageable handle 27*a* so that the handle is then not accessible and the operator cannot push the receptacle 27 downwardly against the opposition of the spring 137. The purpose of moving the receptacle 27 downwardly is to move a cutter 31 relative to a fixed cutter 30 and to thereby sever the problem film 1*a* downstream of the advancing means including the rolls 28 and 29. The severing means including the cutters 30, 31 operates between the advancing rolls 28, 29 and the funnel-shaped film guiding portion 24*b* at the upper end of the vertical portion of the path which is defined by the second film channel 24.

The darkroom 49 further comprises a front wall 39 which is spaced apart from the rear wall 35 and consists of an opaque material. This front wall 38 has an opening in the form of a window 38*a* which can be closed by a pivotable or otherwise movable door 39. The door 39 has a window 39*a* which is only slightly smaller than the window 38*a* of the front wall 38. The window 39*a* is preferably surrounded by a profiled member which stiffens the door 39. The door 39 forms part of the aforementioned inlet 149 which affords to an attendant access to the interior of the darkroom 49. To this end, the door 39 carries a structure which can be similar to or identical with that in the aforesaid commonly owned copending patent application Ser. No. 040,868 of Zangenfeind et al. FIG. 2 merely shows a first light barrier 41 which preferably includes two cuffs with expandible openings 41*a* (only one can be seen in FIG. 2) through which an operator can insert her or his hands so as to reach a second light barrier 42 including two or more overlapping curtains which can be moved apart to expose a second normally closed opening by way of which the hands can reach the interior of the darkroom 49 and the parts of the unwinding units 48 and 20. The first light barrier 41 is mounted on a cover 40 which is pivotably mounted on the door 39 and can actuate a switch 44. The switch 44 can interrupt the flow of electrical energy to the electrically operated parts in the interior of the darkroom 49 in response to pivoting of the cover 40 from its operative position. The switch 44 transmits signals to the aforementioned control circuit.

FIG. 2 further shows that the means for rotating the roll 28 of the means 28, 29 for advancing problem films 1*a* from the compartment 27*a* of the receptacle 27 can comprise an input element in the form of an elongated knurled shaft 28*a* which extends through the aperture 32*a* of the closure 32 toward the inner or second light barrier 42 so that it can be manipulated by one hand of the operator who has gained access to the interior of the darkroom 49. The shaft 28*a* can be provided in addition to or in lieu of a suitable prime mover, such as a pneumatic motor or an electromagnet which can be actuated by the operator to start rotation of the roll 28 in a direction to advance a problem film 1*a* from the compartment 27*a* into the vertical portion of the path which is defined by the second film channel 24.

The mode of operation of the apparatus which is shown in FIGS. 1 and 2 is as follows: The feeding means 45 receives a succession of cassettes 101 in proper orientation in a manner as disclosed, for example, in the aforementioned commonly owned U.S. Pat. No. 4,643,371 to Würfel et al. Properly oriented cassettes 101 descend in the feeding means 45 into the range of the removing means 46 which removes the reels 1 from the respective cassettes 101 and places the removed reels 1 into the range of the transferring mechanism 47. The latter delivers the reels 1 into the chamber of the housing forming part of the first unwinding unit 48. The housing wall or section 5 is pivoted to the operative position of FIG. 1 as soon as a freshly transferred reel 1 is properly received in the unwinding unit 48, and the friction wheel 7 is moved to operative position so that it turns the reel 1 in a counterclockwise direction whereby the stripping device 5*a* compels the leader of the film 1*a* to advance between the extensions 2*a* and 5*b* toward the space between the trimming knives 8 and 9. A detector 109 is provided to detect the leader of the film 1*a* and to transmit to the control circuit a signal which is used to actuate the motor 108 so that the upper trimming knife 8 descends and cooperates with the fixed lower trimming knife 9 to trim the leader of the film 1*a*. The arrangement is preferably such that the detector 109 transmits a signal when the relatively narrow tongue at the leading end of the film 1*a* has advanced beyond the trimming station including the knives 8 and 9. Consequently, the knives 8 and 9 cooperate to trim the film 1*a* in such a way that the relatively narrow tongue is cut away and the freshly formed (full-width) leader of the trimmed film 1*a* has a front edge face which extends all the way between its two perforated marginal portions. The manner in which the marginal portions of a film are perforated can be seen in commonly owned U.S. Pat. No. 4,565,442 to Benker et al. (granted Jan. 21, 1986). Such trimming of the leaders of films 1*a* reduces the likelihood that the film portion which is to be engaged by the transporting rolls 12, 13 has damaged perforated marginal portions.

The freshly trimmed leader of the film 1*a* thereupon enters the nip of the transporting rolls 12 and 13, and the control circuit then transmits a signal to the motor 105 to pivot the housing portion or section 5 in the first unwinding unit 48 to its inoperative position so that the pull of the film 1*a* which is being advanced by the transporting rolls 12 and 13 causes the reel 1 to leave its chamber in the unit 48 and to move against the upwardly sloping ramp 6*b* of the bearing 6. The leader of the film 1*a* is advanced by the transporting rolls 12 and 13 in the channel 10 on toward the sensors 16 and 17 which ensure that the motor 113 for the driven transporting roll 13 is arrested at the exact time when the trimmed leader of the film 1*a* is located in an optimum position at the splicing station, namely when such leader abuts the trailing end of the preceding film 1*a* and more particularly the trailing end of the growing strip or web 101*a*. The heat-sealing device 18 of the splicing means is then caused to descend toward the anvil 19 and to apply a heated strip 18*a* which bonds the trailing end of the web 100*a* to the leader of the film 1*a* in the channel 10.

The transporting rolls 12, 13 and/or the collecting means 118, 218 continue to draw the film 1*a* off the reel 1 which abuts the ramp 6*b* of the bearing 6 until the tension of the film 1*a* between the bearing 6 and the transporting rolls 12, 13 increases. This causes the transporting roll 12 to come to a standstill which is detected by the detector 212 in cooperation with the perforated disc 112 and the control circuit receives an appropriate signal which initiates operation of the motor 108 so that the trailing end of the film 1*a* in the channel 10 is trimmed in response to downward movement of the knife 8. The film 1*a* is then again free to advance toward the collecting station, and the sensors 16, 17 ensure that the trailing end (which was trimmed by the knives 8 and 9) comes to rest in an optimum position at a level above the anvil 19 to be spliced to the leader of the next-following customer film 1*a*. Once the trailing end of a film 1*a* has been trimmed downstream of the bearing 6, the thus freed reel 1 is caused or permitted to automatically descend beyond the ramp 6*b* so as to provide room for the next-following reel 1 which is already located in the chamber of the first unwinding unit 48. The mobile section or wall 5 of the housing of the unit 48 is then pivoted by the motor 105 so that it reassumes the operative position of FIG. 1 and the unit 48 is ready to proceed with the unwinding of film 1*a* from the reel 1 which is then confined in its chamber. In other words, the friction wheel 7 can again move to operative position so as to rotate the reel 1 in a counterclockwise direction. The same procedure is repeated again and again, as long as the customer films 1*a* on the reels 1 which are delivered to the first unwinding unit 48 are satisfactory.

The situation is different if a film 1*a* which is to be unwound in the unit 48 is a problem film, for example, because it has been wound on the core of its reel 1 in the wrong direction, because it has a damaged leader or because it is not properly connected with the core of the respective reel. The unwinding unit 48 attempts to treat such problem film in the same way as a satisfactory film. However, if it is not possible to properly advance the problem film into and through the first film channel 10, the unit 48 transmits a signal to the control circuit, and such signal can be displayed at 50 (outside of the darkroom 49 so that an attendant is informed that the reel 1 with problem film 1*a* must be transferred from the first unwinding unit 48 into the compartment 27*a* of the receptacle 27 of the second unwinding unit 20). The attendant then opens the cover 40 to thereby open the switch 44 which transmits to the control circuit a signal to disconnect all current-consuming parts from the energy source. Moreover, pivoting of the cover 40 to its open position enables the attendant to reach the first light barrier 41, i.e., to insert her or his hands through the normally contracted openings 41*a* and to move apart the curtains of the second light barrier 42 so that the hands can enter the interior of the darkroom 49. The openings 41*a* are normally contracted to such an extent that they cannot permit penetration of any light into the interior of the darkroom 49. When the hands of the operator have been caused to pass through the openings 41*a*, the light barrier 41 contracts around the wrists or arms of the attendant so that no light can penetrate beyond the first light barrier 41. However the hands of the attendant are then free to part the curtains of the second light barrier 42 and to thus gain access to the film unwinding units 48 and 20. The curtains of the second light barrier 42 preferably overlap each other in such a way that they provide or expose a substantially vertically extending opening when they are parted by the hands which already extend through the first light barrier 41.

A signal from the switch 44 in response to opening of the cover 40 is transmitted to the control circuit which automatically actuates the motor 105 and a similar motor (not shown) for the movable lower section 2 of the housing of the first unwinding unit 48 so that the sections 5 and 2 are moved to their inoperative positions and enable one hand of the attendant to grip the reel 1 of the problem film 1*a* and extract it from the unit 48. The removal preferably takes place in such a way that the orientation of the reel 1 which is being withdrawn from the housing of the unit 48 remains substantially unchanged. One hand of the attendant removes the leader of the problem film 1*a* from the nearest convolution of such film on the core of the respective reel 1, and the other hand of the operator at the same time prevents clockspringing of the unwound leader of the problem film. The attendant preferably unwinds a relatively short portion of the leader of the problem film, such as may equal the length of a finger. The right hand holds the reel 1 while the left hand holds the straightened out unwound portion of the leader of the problem film 1*a*.

The just described manipulation of the reel 1 for a problem film 1*a* takes place subsequent to actuation of the pawl 33 so that the closure 32 can be pivoted to its inoperative or second position 32' (shown in FIG. 2 by broken lines). This conceals the manually engageable handle 27*e* of the receptacle 27 in the second film unwinding unit 20. In addition, the operator thereby moves the idler roll 29 out of the cavity 27*g* in the receptacle 27 and away from the roll 28 of the film advancing means. The operator then inserts the reel 1 into the compartment 27*a* of the receptacle 27 while the left hand threads the leader of the film into the substantially horizontal portion of the path which is defined by the second film channel 24. If the leader of the problem film 1*a* is properly introduced into the outlet 27*c* of the receptacle 27, it overlies the roll 28 of the advancing means. If the reel 1 is properly inserted into the compartment 27*a*, the projecting portion of the core of the reel extends rearwardly into the narrower portion 27*b* of the compartment 27*a*, and the front flange of the reel 1 is substantially flush with the exposed front side of the receptacle 27, namely with that side which confronts the inlet 149 of the darkroom 49.

Once the reel 1 with the problem film 1*a* is properly inserted into the compartment 27*a*, the operator pivots the closure 32 from the second position 32' to the solid-line position of FIG. 2 whereby the pawl 33 enters the aperture 32*a* of the closure 32 and the spring 34 biases the pawl 33 clockwise (as seen in FIG. 2) so that the closure 32 is pulled downwardly and urges the roll 29 of the advancing means toward the roll 28, i.e., toward the leader of the problem film 1*a* which overlies the roll 28. As mentioned above, the hinge 32*b* enables the closure 32 to move in its vertical plane (while it overlies the open side of the receptacle 27) under the bias of the spring 34 so as to ensure that the upper roll 29 of the advancing means bears against the leader of the problem film in the outlet 27*c* of the compartment 27*a*. Two fingers then engage the knurled shaft (input member) 28*a* of the lower roll 28 and rotate the roll 28 in a counterclockwise direction, as seen in FIG. 1, so as to advance the problem film 1*a* past the advancing means 28, 29 and toward the vertical portion of the path which is defined by the second film channel 24. As shown in FIG. 1, the leader of the problem film 1*a* can actually advance beyond the vertical portion of the path which is defined by the film channel 24 and hence beyond the severing means including the knives 30 and 31. The hand of the operator contacts the projecting leader of the problem film 1*a* to ascertain whether or not it is damaged. If it is not damaged, the operator depresses the handle 27*e* so as to lower the entire receptacle 27 with the severing knife 31. This enables the knife 31 to cooperate with the stationary knife 30 and to separate the damaged foremost portion of the leader of the problem film 1*a*. The operator thereupon again rotates the shaft 28*a* so as to advance the freshly severed problem film 1*a* toward the funnel-shaped film guiding portion 24*b* wherein the trimmed leader is automatically deflected into the vertical portion of the path which is defined by the film channel 24 and advances toward the cam 10*a* to be diverted into the nip of the transporting rolls 12 and 13. That portion of the path defined by the film channel 24 which is located immediately downstream of the outlet 27*c* preferably slopes downwardly at an angle of approximately 30 degrees to the horizontal (i.e., to the horizontal path of the problem film in the outlet 27*c*). This ensures that the trimmed leader is more likely to find its way into the funnel-shaped film guiding portion 24*b* and into the path portion between the elements 25, 26 of the film detector in the film channel 24. The arrangement may be such that the shaft 28*a* is rotated until the detector including the elements 25, 26 reports to the control circuit the presence of the leader of the problem film 1*a* in the vertical portion of the path which is defined by the film channel 24. The control circuit then starts the aforementioned motor which automatically rotates the advancing roll 28 in order to advance the trimmed leader of the problem film 1*a* into the nip of the transporting rolls 12 and 13. The provision of motor means for the roll 28 is an optional feature of the invention, i.e., the operator can continue to rotate the shaft 28*a* until the trimmed leader of the problem film 1*a* actually enters the nip of the transporting rolls 12 and 13. The operator is then free to withdraw her or his hands, first through the opening of the second light barrier 42 and thereupon through the openings 41*a* of the first light barrier 41. When the cover 40 is returned to the closed position, the switch 44 transmits to the control circuit a signal indicating that the apparatus is again ready for automatic operation. The control circuit then causes the transporting rolls 12 and 13 to advance the leader of the problem film 1*a* into the region of the sensors 16, 17 which arrest the trimmed leader of such film in an optimum position for splicing to the trailing end of the web 101*a* in the same way as if the problem film 1*a* were a satisfactory film.

The operator will interfere with normal operation of the apparatus if the film 1*a* is improperly wound on the reel 1 in the chamber of the first unwinding unit 48. The operator who removes the reel 1 from the chamber of the unit 48 senses the improper orientation of the projecting portion of the core of such reel and ensures that the orientation of the reel is changed prior to insertion into the compartment 27*a* of the receptacle 27. The operator must detect such improper orientation of the reel 1 not later than during insertion into the compartment 27*a* because the reel can be inserted only if the projecting portion of its core faces away from the observer of FIG. 1, namely when such projecting portion of the core can enter the rearwardly tapering portion 27*b* of the compartment 27*a*. At such time, the film 1*a* and its reel 1 will be inserted into the upper portion or half of the compartment 27*a*. A problem film which is properly wound on its reel 1 is inserted into the lower portion of the compartment 27*a*. The outlet 27*c* can properly receive the leader of a problem film 1*a* regardless of whether the corresponding reel 1 is located in the upper or in the lower half of the compartment 27*a*.

The elongated compartment 27*a* of the receptacle 27 in the second unwinding unit 20 exhibits additional important advantages. For example, if the problem film 1*a* is already separated from the reel 1 and forms a roll of convolutions, the operator can reduce the diameter of such roll of problem film and can introduce the thus treated problem film into the compartment 27*a*. Furthermore, and as already mentioned above, the elongated shape of the compartment 27*a* renders it possible to properly insert reels with correctly or incorrectly wound problem films 1*a* thereon. Still further, the elongated shape of the compartment 27*a* facilitates insertion of a reel 1 into, as well as withdrawal of a reel from, the receptacle 27 of the second film unwinding unit 20. If a reel is improperly inserted into the compartment 27*a* so that the projecting portion of its core extends forwardly (toward the inlet 149 of the darkroom 49, the operator cannot move the closure 32 to the solid-line position of FIG. 2. This serves as a warning that the operator should check the position of the reel 1 in the compartment 27*a* and to change the orientation of such reel so as to ensure that the projecting portion of the core will enter the narrower part 27*b* of the compartment 27*a* before the closure 32 is moved to its operative position and the operator can gain access to the handle 27*e* in order to trim the leader of the problem film 1*a* by causing the receptacle 27 and the knife 31 of the severing means 30, 31 to descend against the opposition of the spring 137.

When the leader of the problem film 1*a* is already spliced to the trailing end of the growing web 101*a*, and the unwinding of problem film from the reel 1 in the compartment 27*a* of the receptacle 27 continues, the transport comes to a stillstand when the unwinding is completed but the trailing end of the film 1*a* continues to adhere to the core of the reel in the compartment 27*a*. The detector 212 then transmits to the control circuit a signal denoting that the transport of the problem film 1*a* is interrupted. The control circuit then actuates the pneumatic motor 37 so that the receptacle 27 descends without depressing the handle 27*a* and the knife 31 cooperates with the knife 30 to trim the trailing end of the unwound problem film so that only the short portion of such problem film remains attached to the core of the reel 1 in the receptacle 27. The control circuit then starts the motor 113 so that the transporting rolls 12, 13 advance the trimmed trailing end of the problem film 1*a* into the splicing station where the trailing end is caused to assume an optimum position for splicing to the leader of the next-following (satisfactory or problem) film 1*a*. The apparatus then automatically advances successive satisfactory customer films 1*a* from the first unwinding unit 48 toward the splicing station until the unit 48 again reports the presence of a problem film. The next operation then involves insertion of hands through the light barriers 41 and 42, and removal of the empty reel 1 from the compartment 27*a* (subsequent to lifting of the closure 32 to the second position 32′) so as to provide room for the reel 1 with a freshly discovered problem film 1*a* thereon. The closure 32 maintains an empty reel 1 in proper position in the compartment 27*a* until the hand of an operator opens the closure by lifting the pawl 33 against the opposition of the spring 34 so that the flap-like closure 32 can be pivoted to the position 32′ and enables the operator to withdraw the empty reel 1 from the compartment 27*a*. In other words, when the improved apparatus is in use, and the apparatus has already discovered at least one problem film, the compartment 27*a* invariably contains an empty reel 1 which must be removed by the hands of an attendant preparatory to transfer of the reel with freshly discovered problem film 1*a* from the first unwinding unit 48 into the second unwinding unit 20.

The improved apparatus further renders it possible to properly process remnants of torn or broken films which have been separated from their reels. Such remnants can be introduced into the compartment 27*a* and their leaders are then introduced into the outlet 27*c* so as to ensure that they can be trimmed at 30, 31 to be thereupon advanced by rolls 28, 29 into the guide portion 24*b* on their way toward the cam 10*a* and the nip of the transporting rolls 12, 13. This ensures that such remnants of films can be advanced all the way to the splicing station including the parts 18, 19 and connected to the trailing end of the growing web 101*a*. The only exceptions are problem films which have strongly damaged perforated marginal portions so that such films cannot be properly manipulated in the improved apparatus. The films with strongly damaged marginal portions are simply removed from the darkroom 49 (subsequent to insertion into light-tight containers) and are processed separately in a hanger type apparatus, not shown. Only those films which are evidently incapable of being properly treated in the apparatus of FIGS. 1 and 2 must be removed and treated separately. Such mode of operation ensures that the extremely costly and time-consuming manipulation of certain infrequently discovered problem films takes place only when it cannot be avoided, namely when the apparatus of FIGS. 1 and 2 cannot process the respective problem films in the aforedescribed manner.

While it is possible to orient the outlet 27*c* of the receptacle 27 in a different way so that it is not substantially horizontal, the illustrated orientation is preferred at this time because it is biotechnologically most convenient for manipulation of problem films in the second film unwinding unit 20.

The task of the attendants can be simplified still further if the apparatus is designed with means for generating audible signals during certain stages of operation. For example, when the trimmed leader of a problem film 1*a* reaches the monitoring station including the detector 25, 26, the control circuit of the apparatus can cause the generation of a first audible signal which indicates to the operator that the leader of the problem film is about to reach the nip of the transporting rolls 12 and 13. Two audible signals can be generated at the time when the leader of a film reaches the splicing station between the anvil 19 and the heat-sealing device 18. This indicates to the operator that she or he can withdraw her or his hands from the inlet 149 because the leader of the problem film 1*a* has been properly advanced to the splicing station. It is preferred to ensure that the splicing station can be set in operation to connect the leader of a problem film 1*a* with the trailing end of the web 101*a* when the cover 40 of the inlet 149 is closed, i.e., when the switch 44 has transmitted to the control circuit a signal denoting that the hands of the attendant are already withdrawn from the openings 41*a* of the first light barrier 41.

The improved apparatus exhibits a number of important advantages. These include in particular a reduction of the number of problem films which must be withdrawn from the darkroom 49 for separate and time-consuming treatment in different apparatus. Moreover, a single darkroom 49 suffices for the treatment of all films with the possible exception of a few damaged films which are incapable of advancing through the film channel 10 and/or 24.

Furthermore, the equipment which is installed in the dark chamber 49 is compact so that the transfer of a problem film from the first unwinding unit 48 into the second unwinding unit 20 takes up little time. The operation of the equipment in the dark chamber 49 can be automated to any desired extent with the sole exception of transferring of reels 1 with problem films 1*a* from the first unwinding unit 48 into the second unwinding unit 20. Furthermore, the operator can introduce containers with problem films into the darkroom 49 for insertion into the second film unwinding unit 20 and for processing of such problems in the same way as described above in connection with problem films which are transferred from the unit 48 into the unit 20.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

The band 221 coming as a piece in a certain length from a roll 121 is to be connected by the heat sealing device with the trailing end of the last film on the roll in the collecting means 118. This piece is then the leading end for the film which is drawn into the developing machine by means of this band.

What is claimed is:

1. Apparatus for converting undeveloped photographic roll films which are convoluted on reels into a continuous web of coherent films, comprising a darkroom; first and second film unwinding units in the interior of said darkroom; web collecting means in said darkroom; means defining in said darkroom a first film channel extending from said first unit toward said collecting means; means for splicing together successive films in said channel end-to-end so as to convert such films into a web; and means defining a second film channel extending from said second unit to a portion of said first channel between said splicing means and said first unit, said darkroom having at least one normally sealed inlet for affording access to said units by at least one hand for manual transfer of reels from said first unit into said second unit and, if necessary, for threading the film on a transferred reel into said second channel.

2. The apparatus of claim 1, further comprising means for feeding cassettes with reels of undeveloped films into said darkroom, means for removing reels from cassettes in said darkroom, and means for transferring reels from said removing means into said first unit.

3. The apparatus of claim 1, wherein said second unit comprises a receptacle for transferred reels and said second channel extends from said receptacle to said portion of said first channel.

4. The apparatus of claim 1, further comprising means for trimming the leaders of films in at least one of said channels.

5. The apparatus of claim 1, further comprising means for trimming the trailing ends of films in at least one of said channels.

6. The apparatus of claim 1, wherein said inlet comprises a first light barrier having at least one normally sealed manually expandible first opening for the hand of an attendant, and a second light barrier between said first light barrier and the interior of said darkroom, said second barrier having at least one normally sealed second opening which is expandible by the hand extending through said first opening.

7. The apparatus of claim 1, wherein said second unit comprises a receptacle for transferred reels and means for advancing the film from a reel in said receptacle, in said second channel and toward said portion of said first channel, and further comprising means for severing films in said second channel.

8. The apparatus of claim 1, wherein said second unit comprises a receptacle for transferred reels, said receptacle having an open reel-admitting side confronting the inlet of said darkroom.

9. The apparatus of claim 8, wherein said receptacle defines for the reels an elongated compartment including two substantially mirror symmetrical halves and having an outlet communicating with said compartment substantially intermediate said halves and arranged to direct the leader of a film in said compartment into said second channel.

10. The apparatus of claim 9, further comprising means for advancing films from said compartment, in said second channel and toward said portion of said first channel, said advancing means including mobile film engaging elements adjacent said outlet 11. The apparatus of claim 9, wherein said compartment is dimensioned to receive a reel in each of said halves.

12. The apparatus of claim 1, wherein said second unit comprises a receptacle for transferred reels and means for advancing the film from a reel in said receptacle, in said second channel and toward said portion of the first channel, said second channel defining a predetermined path for advancement of films from said receptacle and said advancing means comprising a driven roll at one side of said path and an idler roll at the other side of said path opposite said driven roll, at least one of said rolls being mounted on said receptacle.

13. The apparatus of claim 12, wherein said receptacle has an open side confronting said inlet and said second unit further comprises a mobile closure for said open side, the other of said rolls being mounted on said closure.

14. The apparatus of claim 13, further comprising means for movably mounting said closure in said darkroom.

15. The apparatus of claim 14, wherein said closure is movable to and from an operative position in which it overlies the open side of said receptacle, and further comprising means for biasing said other roll toward said one roll in the operative position of said closure.

16. The apparatus of claim 15, further comprising means for releasably locking said closure in said operative position, said locking means including said biasing means.

17. The apparatus of claim 16, wherein said mounting means includes a hinge and said closure is movable relative to said receptacle in the operative position thereof in directions to move said other roll toward and away from said one roll, said locking means including a pawl and said biasing means including at least one spring arranged to urge the pawl against the closure in the operative position of the closure and to thereby urge said other roll toward said one roll.

18. The apparatus of claim 13, further comprising prime mover means for said driven roll.

19. The apparatus of claim 13, further comprising manually operable means for rotating said driven roll.

20. The apparatus of claim 19, wherein said closure has an aperture and said manually operable means comprises a rotary input member extending toward said inlet and through said aperture in the operative position of said closure.

21. The apparatus of claim 1, wherein said second unit comprises a receptacle for transferred reels, said receptacle having a reel-receiving compartment and an outlet for directing a film from the reel in said compartment into said second channel, said outlet being disposed in a predetermined plane and said second unit further comprising means for movably supporting said receptacle so that the receptacle is movable substantially at right angles to said plane, and further comprising means for severing the film in said second channel including first cutter means movable with said receptacle and fixed second cutter means adjacent said first cutter means.

22. The apparatus of claim 21, wherein said receptacle is movable between a first position in which said severing means is inoperative and a second position, said first cutter means being arranged to cooperate with said second cutter means so as to sever the film in said second channel during movement of said receptacle from said inoperative to said second position, said second unit further comprising means for biasing said receptacle to said inoperative position.

23. The apparatus of claim 22, further comprising manually engageable means for moving the receptacle to said second position.

24. The apparatus of claim 23, wherein said receptacle has an open side confronting said inlet and said second unit further comprises a closure movable between a first position in which the closure overlies the open side of the receptacle and a second position in which the closure prevents access to said manually engageable means while the receptacle is accessible for insertion or removal of reels.

25. The apparatus of claim 1, further comprising means for severing the film in said second channel and means for actuating said severing means.

26. The apparatus of claim 25, wherein said actuating means comprises a fluid-operated motor.

27. The apparatus of claim 25, wherein said actuating means comprises an electromagnet.

28. The apparatus of claim 25, further comprising means for initiating the severing of film by way of said actuating means including means for monitoring the tension of film in one of said channels and for transmitting to said actuating means a signal when the monitored tension assumes a predetermined value.

29. The apparatus of claim 25, further comprising means for initiating the severing of film in said second channel by way of said actuating means including means for scanning one of said channels for the presence of moving film therein and for transmitting to said actuating means a signal in response to detected stoppage of the film.

30. The apparatus of claim 1, wherein said second unit comprises a receptacle for transferred reels, said receptacle having a substantially horizontal outlet for admission of film into said second channel and further comprising means for severing the film in said second channel, said second channel defining a predetermined path for the film therein and said path including a portion adjacent said severing means and sloping downwardly with respect to said outlet.

31. The apparatus of claim 30, wherein said portion of said path slopes downwardly through an angle of approximately 30 degrees.

32. The apparatus of claim 30, wherein said path further includes a substantially vertical portion extending from said downwardly sloping portion toward said portion of said first channel.

33. The apparatus of claim 32, wherein said second channel includes a substantially funnel-shaped film guiding portion between said portions of said path.

* * * * *